US008444244B2

(12) United States Patent
Araki et al.

(10) Patent No.: US 8,444,244 B2
(45) Date of Patent: May 21, 2013

(54) PRINT CONTROL APPARATUS

(75) Inventors: Masatoshi Araki, Kanagawa (JP); Koichi Saitoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 799 days.

(21) Appl. No.: 12/056,391

(22) Filed: Mar. 27, 2008

(65) Prior Publication Data

US 2009/0079781 A1 Mar. 26, 2009

(30) Foreign Application Priority Data

Sep. 26, 2007 (JP) ..... 2007-248587

(51) Int. Cl.
*B41J 29/393* (2006.01)

(52) U.S. Cl.
USPC ..... 347/19; 347/9

(58) Field of Classification Search
USPC ..... 347/5, 12, 14, 19, 57, 78, 246, 9; 355/35, 355/41; 356/629; 358/1.5, 1.9; 382/269, 299
See application file for complete search history.

(56) References Cited

U.S. PATENT DOCUMENTS 4,872,027 A * 10/1989 Buskirk et al. ..... 347/19
5,250,956 A * 10/1993 Haselby et al. ..... 347/19
5,317,390 A * 5/1994 Bolza-Schunemann et al. ..... 356/394
5,534,895 A * 7/1996 Lindenfelser et al. ..... 347/19
5,831,658 A * 11/1998 Iga et al. ..... 347/171
6,003,980 A * 12/1999 Sheinman et al. ..... 347/78
6,010,205 A * 1/2000 Billet ..... 347/40
6,089,693 A * 7/2000 Drake et al. ..... 347/19
6,120,125 A * 9/2000 Kim ..... 347/19
6,168,261 B1 * 1/2001 Miyake et al. ..... 347/40
6,174,039 B1 * 1/2001 Miyake et al. ..... 347/12
6,273,542 B1 * 8/2001 Couwenhoven et al. ..... 347/19
6,354,689 B1 * 3/2002 Couwenhoven et al. ..... 347/19
6,416,151 B1 * 7/2002 Otsuka et al. ..... 347/19
6,450,607 B1 * 9/2002 Bolash et al. ..... 347/19
6,454,390 B1 * 9/2002 Takahashi et al. ..... 347/41
6,523,926 B1 * 2/2003 Mitsuzawa et al. ..... 347/19

(Continued)

FOREIGN PATENT DOCUMENTS

JP 61-261079 11/1986
JP 09-094950 4/1997

(Continued)

OTHER PUBLICATIONS

U.S. Appl. No. 11/881,163, filed Jul. 26, 2007, Araki.

(Continued)

*Primary Examiner* — Charlie Peng
*Assistant Examiner* — Peter Radkowski
(74) *Attorney, Agent, or Firm* — Fildes & Outland, P.C.

(57) ABSTRACT

A print control apparatus includes: an operation state storing section that stores operation information relating to operation states of a plurality of printing elements arranged in a printing head; and a drawing controlling section that causes the plurality of printing elements to draw a test image for checking the operation states of the plurality of printing elements, wherein the test image includes a set of a predetermined number of lines that are drawn in parallel with one another in a predetermined direction, and the drawing controlling section causes a printing element placed in the vicinity of a printing element determined as a malfunction on the basis of the operation information, to draw a check line having a predetermined length and thickness in the test image.

17 Claims, 10 Drawing Sheets

U.S. PATENT DOCUMENTS

| | | | | |
|---|---|---|---|---|
| 6,692,096 | B1 * | 2/2004 | Otsuki et al. | 347/14 |
| 6,733,100 | B1 * | 5/2004 | Fujita et al. | 347/12 |
| 7,021,734 | B2 * | 4/2006 | Lee | 347/12 |
| 2001/0003458 | A1 * | 6/2001 | Shioya | 347/19 |
| 2002/0033851 | A1 * | 3/2002 | Waldner et al. | 347/5 |
| 2002/0041304 | A1 * | 4/2002 | Kobayashi et al. | 347/23 |
| 2002/0054179 | A1 * | 5/2002 | Shibata et al. | 347/15 |
| 2002/0124748 | A1 * | 9/2002 | Aida | 101/232 |
| 2002/0126171 | A1 * | 9/2002 | Subirada et al. | 347/19 |
| 2002/0130918 | A1 * | 9/2002 | Hayakawa et al. | 347/29 |
| 2002/0171699 | A1 * | 11/2002 | Choi | 347/19 |
| 2003/0122887 | A1 * | 7/2003 | Bland | 347/19 |
| 2003/0142158 | A1 * | 7/2003 | Lee | 347/12 |
| 2004/0021724 | A1 * | 2/2004 | Kojima | 347/19 |
| 2004/0032446 | A1 * | 2/2004 | Kanda | 347/19 |
| 2004/0224102 | A1 * | 11/2004 | Ebihara | 428/32.1 |
| 2005/0018006 | A1 * | 1/2005 | Im et al. | 347/19 |
| 2005/0046658 | A1 * | 3/2005 | Kojima | 347/19 |
| 2005/0052488 | A1 * | 3/2005 | Inoue | 347/19 |
| 2005/0116981 | A1 * | 6/2005 | Faken et al. | 347/19 |
| 2005/0174384 | A1 * | 8/2005 | Koitabashi et al. | 347/43 |
| 2005/0248788 | A1 * | 11/2005 | Chung et al. | 358/1.9 |
| 2006/0038842 | A1 * | 2/2006 | Chikuma et al. | 347/12 |
| 2006/0061618 | A1 * | 3/2006 | Hernandez et al. | 347/29 |
| 2006/0114284 | A1 * | 6/2006 | Mizes et al. | 347/19 |
| 2007/0064077 | A1 * | 3/2007 | Konno | 347/102 |
| 2007/0070111 | A1 * | 3/2007 | Vladislav | 347/19 |
| 2007/0120885 | A1 * | 5/2007 | Jeong | 347/19 |
| 2008/0212112 | A1 * | 9/2008 | Araki | 358/1.9 |

FOREIGN PATENT DOCUMENTS

| | | | |
|---|---|---|---|
| JP | 2001146004 | A * | 5/2001 |
| JP | 2002-225300 | | 8/2002 |
| JP | 2005-246649 | | 9/2005 |
| JP | 2005-262813 | | 9/2005 |
| JP | 2005-343035 | | 12/2005 |

OTHER PUBLICATIONS

U.S. Appl. No. 11/893,315, filed Aug. 14, 2007, Araki.

* cited by examiner

PRINT CONTROL APPARATUS

CROSS-REFERENCE TO RELATED APPLICATIONS

This application is based on and claims priority under 35 U.S.C. 119 from Japanese Patent Application No. 2007-248573 filed Sep. 26, 2007.

BACKGROUND

1. Technical Field

The present invention relates to a print control apparatus.

2. Related Art

Recently, in accordance with the speeding-up and image quality enhancement in a printing apparatus, the density and number of printing elements of a printing head are advancing. Particularly, many printing apparatuses comprising a printing head in which the printing width is formed to be larger than a recorded region of a recording medium so that images of one printing width can be printed by one operation have been proposed. Among such printing apparatuses, there are apparatuses in which the number of printing elements such as liquid droplet ejecting elements to be mounted on a printing head reaches several thousands.

Many methods of, in such a conventional printing apparatus, identifying a malfunctioning printing element and minimizing degradation of an image quality by an image processing have been proposed. In such methods, it is very important to correctly identify a malfunctioning printing element.

SUMMARY

According to an aspect of the present invention, a print control apparatus includes: an operation state storing section that stores operation information relating to operation states of a plurality of printing elements arranged in a printing head; and a drawing controlling section that causes the plurality of printing elements to draw a test image for checking the operation states of the plurality of printing elements, wherein the test image includes a set of a predetermined number of lines that are drawn in parallel with one another in a predetermined direction, and the drawing controlling section causes a printing element placed in the vicinity of a printing element determined as a malfunction on the basis of the operation information, to draw a check line having a predetermined length and thickness in the test image.

BRIEF DESCRIPTION OF THE DRAWINGS

Exemplary embodiment of the present invention will be described in detail based on the following figures, wherein.

DETAILED DESCRIPTION

Hereinafter, the exemplary embodiment for carrying out the invention will be described with reference to the accompanying drawings.

Figure 1:
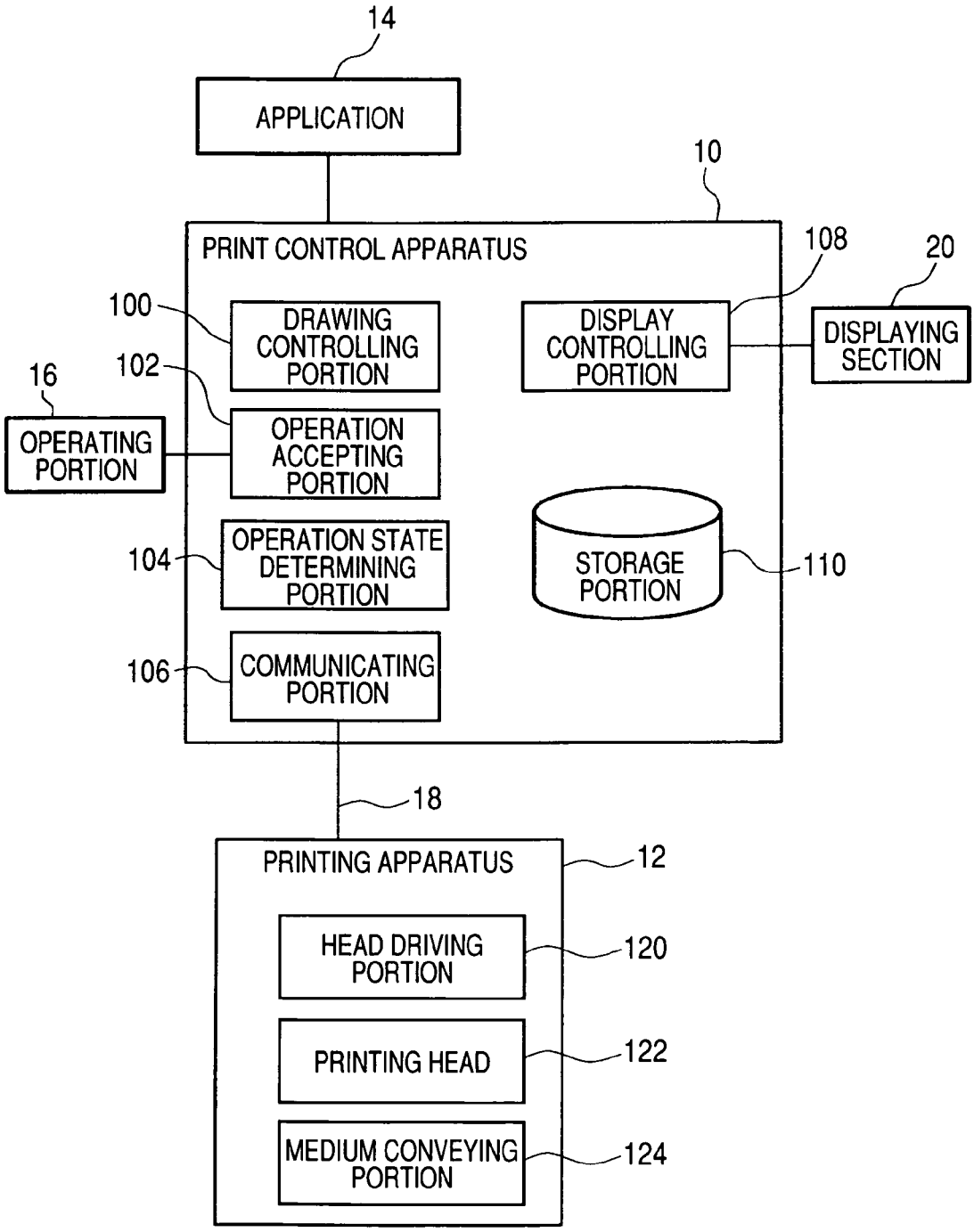
FIG. 1 is a functional block diagram of an exemplary embodiment of a printing system according to the invention.

FIG. 1 is a functional block diagram of an exemplary embodiment of a printing system according to the invention. Referring to FIG. 1, the printing system includes a print control apparatus 10 and a printing apparatus 12. The print control apparatus 10 converts image data which are print objects obtained from an application 14, to data of a format which can be processed by the printing apparatus 12, and supplies the converted image data to the printing apparatus 12. The printing apparatus 12 prints out the converted image data which have been received from the print control apparatus 10. The application 14 is usual software having a function of outputting the image data which are print objects, together with print instructions to the print control apparatus 10.

The print control apparatus 10 is configured on, for example, a computer, and includes a drawing controlling portion 100, an operation accepting portion 102, an operation state determining portion 104, a communicating portion 106, a display controlling portion 108, and a storage portion 110.

The drawing controlling portion 100 is realized by including a central processing unit (in which, for example, a CPU can be used), and programs which control processing operations of the CPU, and converts the image data which are obtained from the application 14, to print data which can be processed by the printing apparatus 12. Furthermore, the drawing controlling portion produces test image data which are used for drawing a test image for checking the operation states of plural printing elements arranged in a printing head 122 of the printing apparatus 12 that will be described later. The test image data may be produced by using data which are previously stored in the storage portion 110, or those which are obtained from the outside via the communicating portion 106.

The operation accepting portion 102 is realized by the CPU, and programs which control processing operations of the CPU, and accepts inputs through an operating portion 16. The inputs include, for example, information relating to the operation states of the plural printing elements arranged in the printing head 122 disposed in the printing apparatus 12. The information relating to the operation states include the serial numbers and operation states of the printing elements. The operation states include a normal state, a print disabled state, and a print position abnormal state. The print position abnormal state means a state of an ejection directionality failure in which, for example, a liquid droplet ejecting element for ejecting a droplet of an ink or the like cannot eject a droplet in a correct direction.

The operation state determining portion 104 is realized by the CPU, and programs which control processing operations of the CPU, and determines the operation states of the printing elements on the basis of the information relating to the operation states of the printing elements which is accepted by the operation accepting portion 102.

The communicating portion 106 is realized by adequate communication interfaces such as a USB (Universal Serial Bus) port, a parallel port, and a network port, and programs which control the interfaces through the CPU, and exchanges the print data and test image data produced by the drawing controlling portion 100, and the like between the print control apparatus 10 and the printing apparatus 12 through communication means 18.

The display controlling portion 108 is realized by the CPU, and programs which control processing operations of the CPU, and controls an operation of displaying images for requesting the operator to input information relating to the operation states of the printing elements, and the like, on a displaying section 20.

The storage portion 110 is realized, for example, by a random access memory (RAM) which is used as a working memory for the CPU, a read-only memory (ROM), a magnetic storage device such as a hard disk drive, and another storage device which is readable by a computer. The storage portion stores programs for controlling processing operations of the CPU, the test image data, information relating to the operation states of the printing elements, etc.

The operating portion 16 is realized by a data inputting device such as a keyboard, a mouse, or a touch panel, and used by the operator for inputting information relating to the operation states of the printing elements, etc. The communication means 18 is configured by a USB (Universal Serial Bus), Centronics, a network such as an intranet, etc. The displaying section 20 is realized by a displaying device such as a liquid crystal display, and displays various images on the basis of the control of the display controlling portion 108.

The printing apparatus 12 is configured by a head driving portion 120, a printing head 122, a medium conveying portion 124, etc.

The head driving portion 120 controls the operation of the printing head 122 on the basis of the print data, test image data, and the like received from the print control apparatus 10.

The printing head 122 is configured by arranging plural printing elements such as ink droplet ejecting nozzles, and prints an image onto a recording medium such as printing sheet.

The medium conveying portion 124 conveys a recording medium onto which an image is to be printed by the printing head 122, in synchronization with the print timing of the printing head 122. When a recording medium passes through a region opposed to the printing head 122, therefore, an image is formed on the recording medium by the printing head 122 in accordance with the print data.

Figure 2:
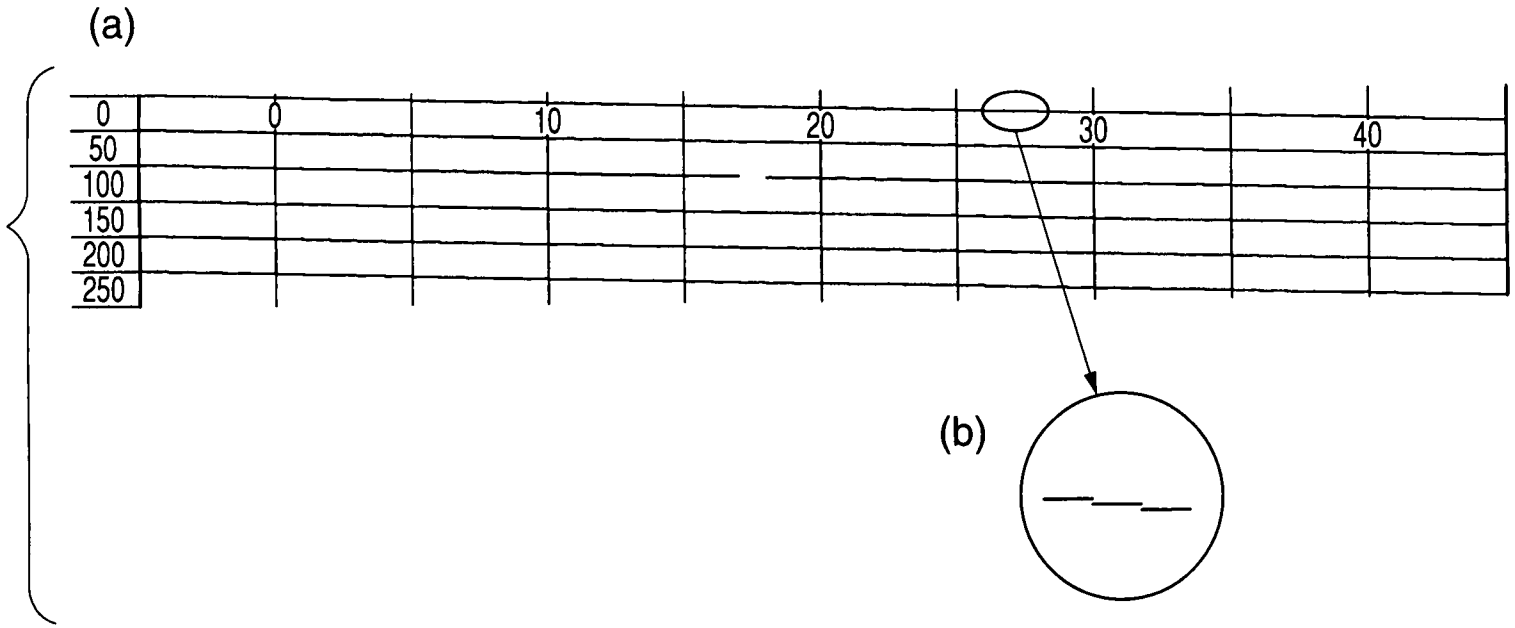
FIG. 2 is a view showing an example of a test image.

In (a) and (b) of FIG. 2, an example of a test image according to the exemplary embodiment is shown. In FIG. 2, (a) shows a test image for identifying a malfunctioning (print disable or print position abnormal) printing element in the case where 300 printing elements are arranged in the printing head 122, and (b) is a partial enlarged view of the test image.

Referring to (a) of FIG. 2, in the test image, horizontal lines (straight lines which are laterally drawn in the figure) correspond to the printing elements arranged in the printing head 122, respectively. As shown in (b) of FIG. 2, a predetermined number of liens which are drawn in parallel with one another are stepwisely drawn. In the example of (a) of FIG. 2, in order to facilitate the reading of the serial numbers of the printing elements, the numbers are additionally written in the test image. Each of the stepwise lines is configured by 50 horizontal lines which are drawn by 50 printing elements, respectively, and numerals from 0 (showing Nos. 0 to 9) to 40 (showing Nos. 40 to 49) are added to the lines. Serial numbers in increments of 50 are added to the steps, respectively.

When there is a printing element of a print disabled state, for example, the horizontal line which is to be drawn by the printing element is not drawn, and is recognized as a vanishing position. In (a) of FIG. 2, an example in which a print disabled state occurred in No. 122 printing element is shown. In the case of a print position abnormal state, a line is drawn with being deviated upwardly or downwardly in the figure.

In the case where the test image of (a) of FIG. 2 is used, the operator reads a print disabled state or a print position abnormal state from the test image, and inputs information relating to the operation state of the printing element through the operating portion 16. For example, the information includes the serial number and operation state (a print disabled or print position abnormal state) of the malfunctioning printing element.

Figure 3:
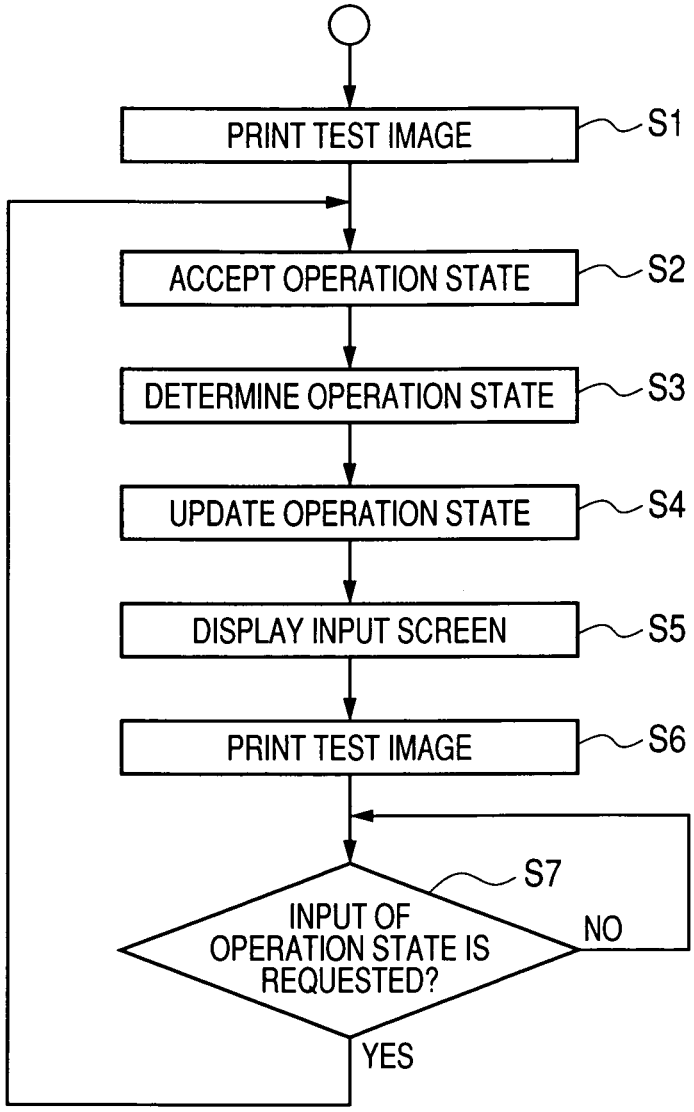
FIG. 3 is a flowchart of an operation example of the printing system according to the invention.
Figure 4A:
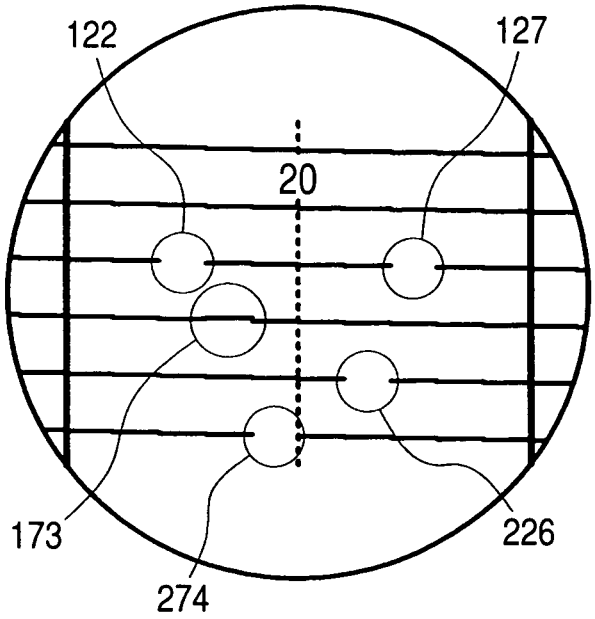
FIGS. 4A and 4B are partial enlarged views of the example of the test image.
Figure 4B:
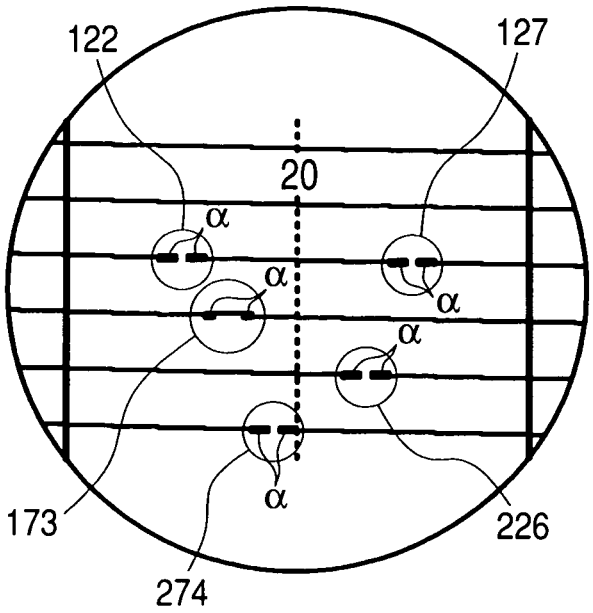
Figure 5:
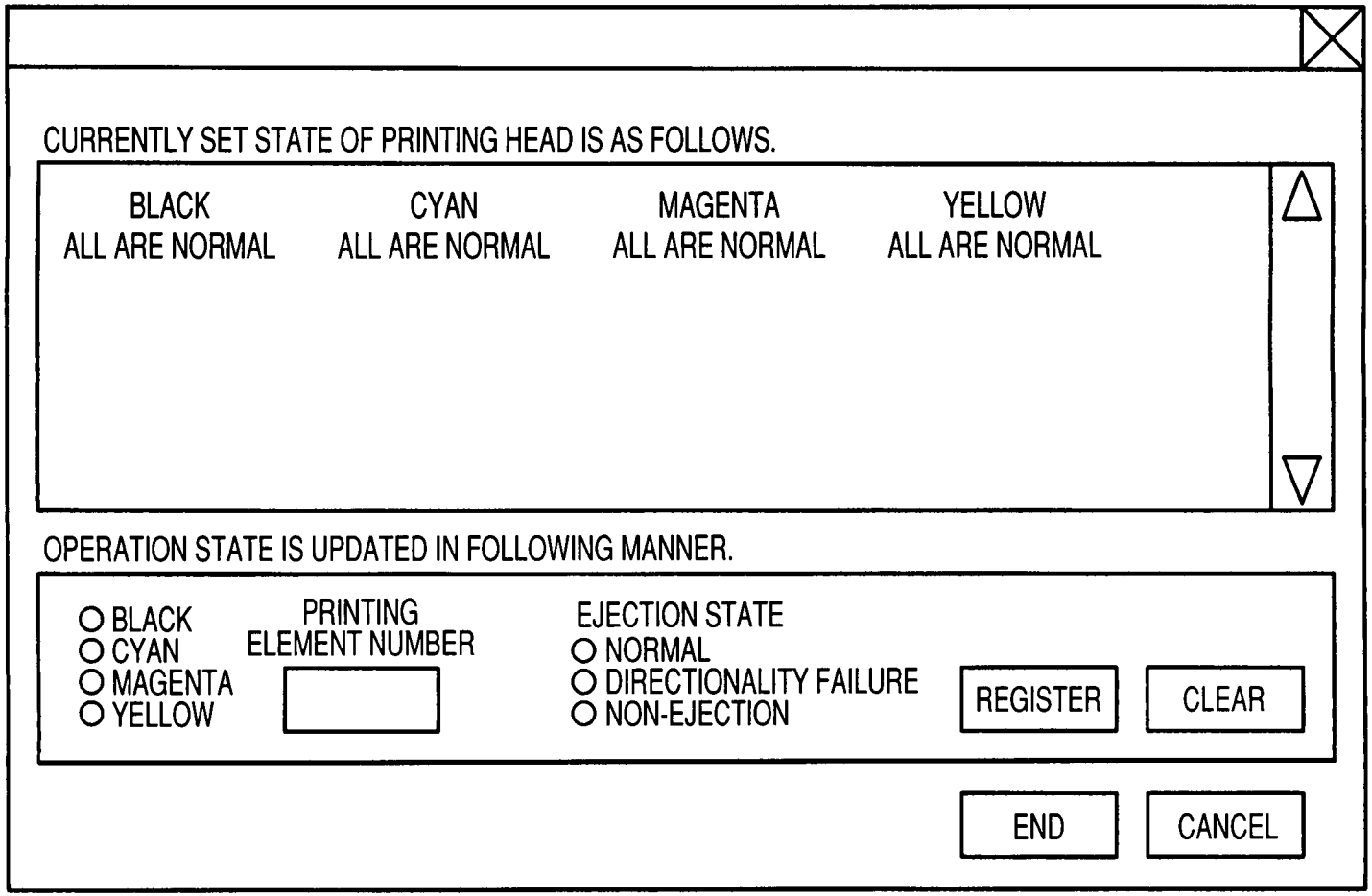
FIG. 5 is a view showing an example of an input screen for inputting information relating to the operation state of a printing element.
Figure 6:
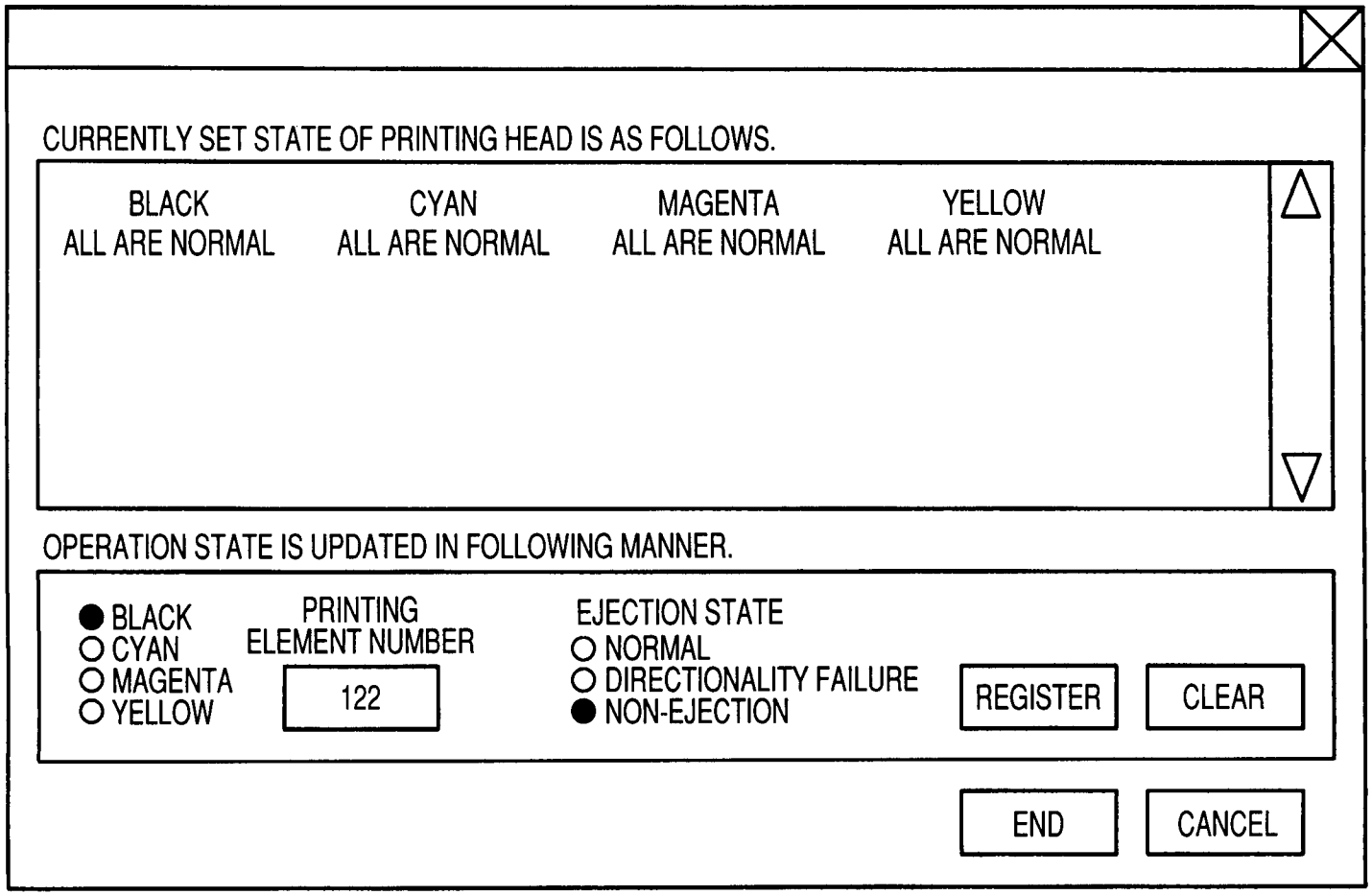
FIG. 6 is a view showing another example of the input screen for inputting information relating to the operation state of a printing element.
Figure 7:
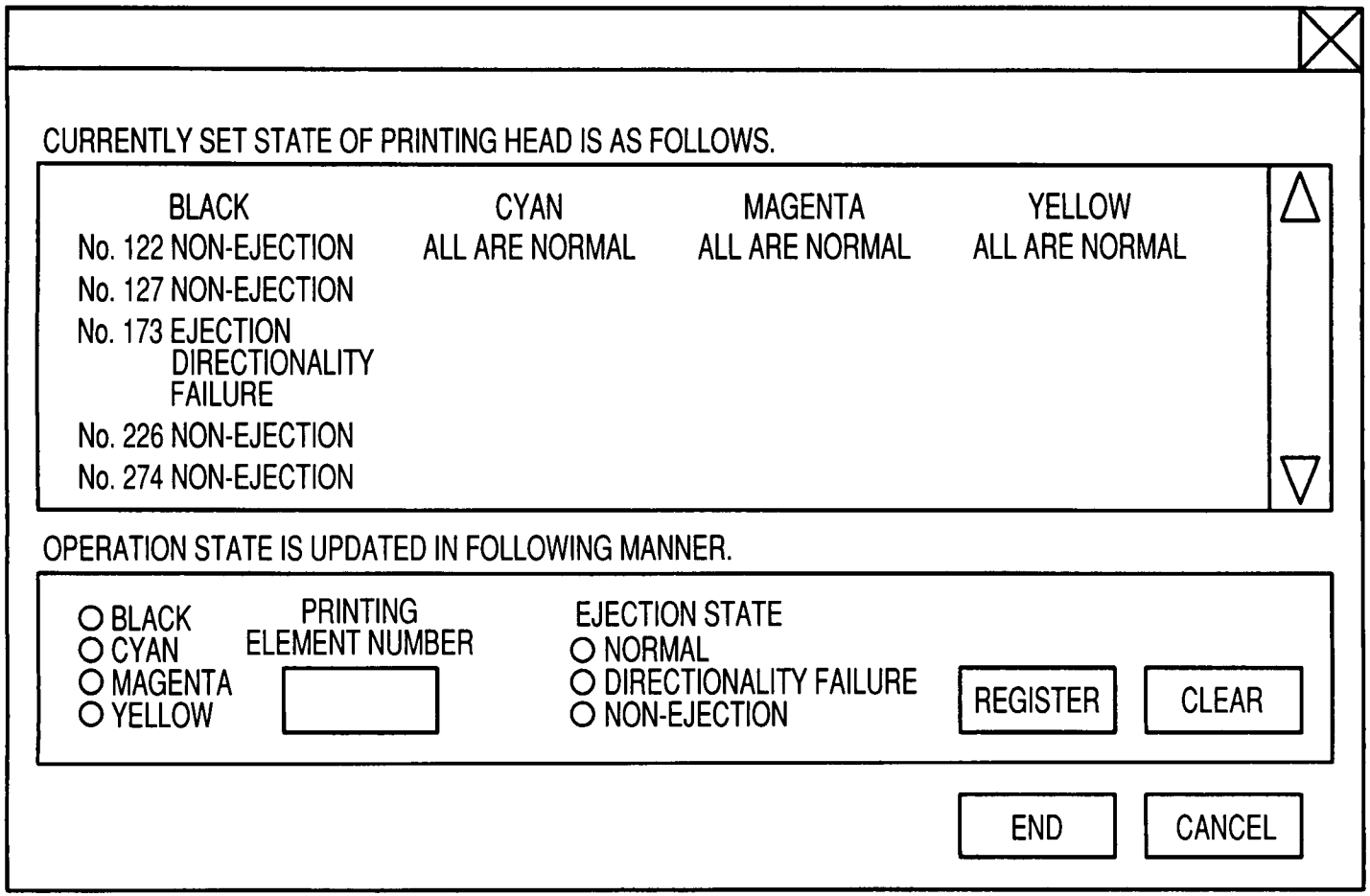
FIG. 7 is a view showing a further example of the input screen for inputting information relating to the operation state of a printing element.

FIG. 3 shows the flow of an operation example of the printing system according to the invention. FIGS. 4A and 4B are partial enlarged views of the example of the test image, and FIGS. 5 to 7 show examples of an input screen for inputting information relating to the operation state of the printing element. These input screens show examples in the case where liquid droplet ejecting elements are used as the printing elements.

The flow of FIG. 3 shows an operation example in the case where, in order to check the operation states of the plural printing elements arranged in the printing head 122, the drawing controlling portion 100 causes the printing apparatus 12 to print a test image onto the recording medium, and the operator observes the test image and inputs information relating to the operation states of the printing elements through the operating portion 16. In the example, the printed test image is output in colors of K (black), C (cyan), M (magenta), and Y (yellow).

Referring to FIG. 3, when the test image is printed out on the basis of print instructions for the test image which is input by the operator through the operating portion 16 (S1), the print control apparatus 10 obtains information of print completion through the communicating portion 106, and the display controlling portion 108 displays an input screen requesting the operator to input information relating to the operation states of the printing elements, on the displaying section 20. In this case, it is assumed that, in the printed test images of black (K), the printing elements of Nos. 122, 127, 226, and 274 are in a non-ejection state (print disabled state), and the printing element of No. 173 is in a state of an ejection directionality failure (print position abnormal) as shown in FIG. 4A. The operator inputs the serial numbers and their operation states (non-ejection or ejection directionality failure state) as information relating to the operation states of the printing elements, through the input screen shown in FIG. 5.

Referring to FIG. 5, in the input screen, an operation state screen for printing elements of the respective colors is shown in the upper stage, and an updation screen for an operation state is shown in the lower stage. As shown in FIG. 6, the operator designates the color and serial number of the malfunctioning printing element, and inputs the operation state. FIG. 6 shows an example in which non-ejection is input for the printing element of No. 122. Similarly, also for the printing elements of Nos. 127, 173, 226, and 274, their operation states are input, and the operation states are registered with operating a registration button. As a result, information relating to the operation states is accepted by the operation accepting portion 102 (S2).

The operation state determining portion 104 determines the operation states (normal, non-ejection, or ejection directionality failure state) of the printing elements, on the basis of the information relating to the operation states accepted by the operation accepting portion 102 (S3). Next, the operation state determining portion 104 updates the information relating to the operation states of the printing elements, based on the result of the determination result (S4). The information relating to the operation states is stored in the storage portion 110.

The display controlling portion 108 updates the operation state screen in the upper stage of the input screen on the basis of the operation states of the printing elements updated by the operation state determining portion 104, and displays the updated screen (S5). The drawing controlling portion 100 updates the test image data on the basis of the operation states of the printing elements updated by the operation state determining portion 104.

When the operator then inputs the print instructions for the test image through the operating portion 16, the drawing controlling portion 100 causes the printing apparatus 12 to print the test image on the basis of the updated test image data (S6).

FIG. 7 shows an input screen in which the operation state screen is updated. In FIG. 7, for the printing elements of black, the malfunctions of the above-mentioned serial numbers are displayed.

FIG. 4B shows the updated test image. Referring to FIG. 4B, in the test image, check lines a having a predetermined length and thickness are drawn by printing elements which are placed in the vicinities of the malfunctioning printing elements. The printing elements placed in the vicinities may be two printing elements adjacent to the both sides of the respective malfunctioning printing elements, or two sets each having two printing elements which are respectively situated on the both sides of the respective malfunctioning printing elements. According to the configuration, each check line $\alpha$ can be made thickened as compared with the thickness of the line drawn by one printing element. Preferably, the length and thickness of each of the check lines are changed in accordance with the operation states of the corresponding printing element, so that the contents of the malfunction of the printing element can be easily visually checked.

With respect to one malfunctioning printing element, as shown in FIG. 4B, it is preferable to draw two check lines which are separated from each other by a predetermined distance in the length direction, because they are easily visible. In the example of FIG. 4B, in the case where the malfunction is caused by non-ejection, the check lines are drawn so as to be longer (so that the gap between them is narrower), and, in the case where the malfunction is caused by an ejection directionality failure, they are drawn so as to be shorter (so that the gap between them is wider). This is performed because non-ejection can be easily visually checked even when the gap between the check lines is narrow, but a visual check of an ejection directionality failure requires a certain degree of gap. Alternatively, the contents of the malfunction of the corresponding printing element may be indicated depending on the length of the check line.

Each of the check lines may be drawn by printing elements which are placed in the vicinity of a malfunctioning printing element, and which are of a color different from that of the malfunctioning printing element. In the case where a malfunction occurs in a printing element of black, for example, printing elements of cyan may be used, so that the visibility can be improved.

In the test image shown in FIG. 4B, the operator checks coincidence between the information relating to the operation states input by the operator, and that recognized by the print control apparatus 10. If there is a discrepancy between them, the operator requests an input of the operation states through the operating portion 16. When the request for an input of the operation states is made (S7), the display controlling portion 108 displays the input screen shown in FIG. 7, and the steps beginning from S2 are repeated so that information relating to the operation states can be again input.

In the case where the discrepancy is to be checked, it is possible to easily visually check whether a drawing which conflicts (a phenomenon such as that a non-ejection state is eliminated, or an ejection directionality failure state is changed to a non-ejection state) with the contents of a malfunction indicated by the length or the like of a check line is in a place where the check line exists or not. A malfunction which exists in a place where a check line does not exist is a newly produced one. Also in this case, the discrepancy can be easily checked. In the exemplary embodiment, the operator is requested to input only information relating to the operation state of a printing element in which the operation state is different from that at the previous input of the information relating to the operation state (the operation state is inconsistent with the previous one).

In the case where a malfunction exists in the operation state of a printing element which is input in the above-described steps, it is preferable to perform a process of correcting the malfunction with using another printing element. As the correcting process, for example, a resolution conversion, a color changing process, a halftone process, or the like may be used.

In the case where, after the above-described correcting process is performed, the operator detects anything wrong in the printing operation during the use of the printing apparatus 12, the steps shown in FIG. 3 may be executed to check the operation state.

The above-described exemplary embodiment is configured so that the operator reads the operation states of the printing elements from the test image, and inputs the operation states into the input screen through the operating portion 16. The invention is not restricted to this. For example, a configuration where a malfunction is detected by a method in which the test image is read by a scanner or the like, or that in which, in the case of liquid droplet ejecting elements, the ejection state is detected by a device for detecting flying of a liquid droplet may be employed. In this case, the operation accepting portion 102 which accepts the information relating to the operation state is unnecessary, and a configuration where the drawing controlling portion 100 or the display controlling portion 108 accepts a malfunction detected by the scanner or the flying detecting device may be employed.

Figure 8:
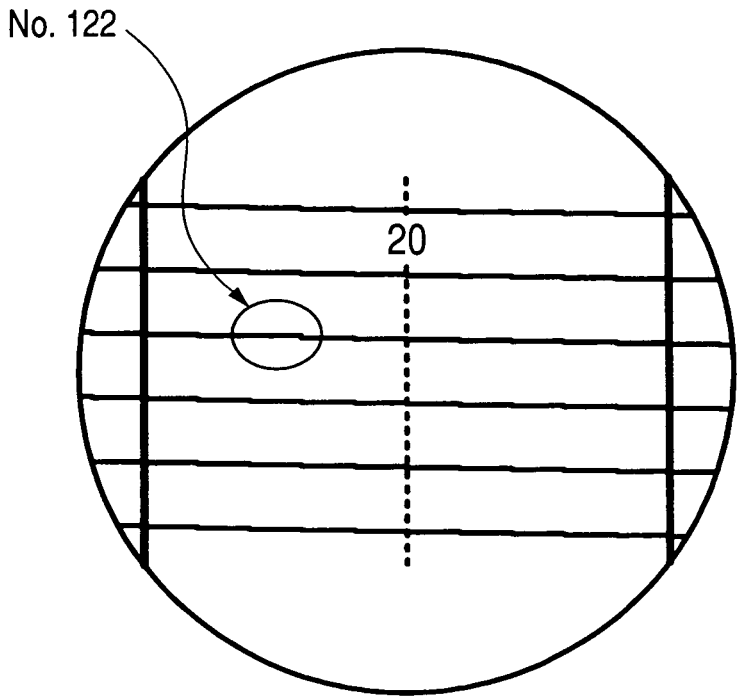
FIG. 8 is a partial enlarged view of another example of the test image.

FIG. 8 is a partial enlarged view of another example of the test image. FIG. 8 shows an example where, when a test image is drawn, a line corresponding to a printing element which is determined as a non-ejection state or an ejection directionality failure state is drawn by a printing element which is adjacent to the malfunctioning element, and which is in the normal state.

Referring to FIG. 8, No. 122 printing element is determined as a non-ejection state, and information indicative of this is stored in the storage portion 110. When a test image is drawn by instructions from the operator, the line to be drawn by No. 122 printing element is drawn by No. 121 printing element which is adjacent to No. 122 printing element. Alternatively, the line may be drawn by No. 123 printing element.

According to the exemplary embodiment, the test image to be printed out is an image which is free from a vanishing position corresponding to a printing element in a non-ejection state that is recognized by the print control apparatus 10. When there is no further vanishing position, it means that no malfunctioning printing element other than the non-ejection state that is recognized by the print control apparatus 10 exists. As a result, the operator can immediately determine that it is not necessary to again check the printing state. By contrast, in the case where there is a further vanishing position, a printing element in the non-ejection state that is not recognized by the print control apparatus 10 exists, and hence the operator can immediately determine that it is necessary to again check the printing state.

Figure 9A:
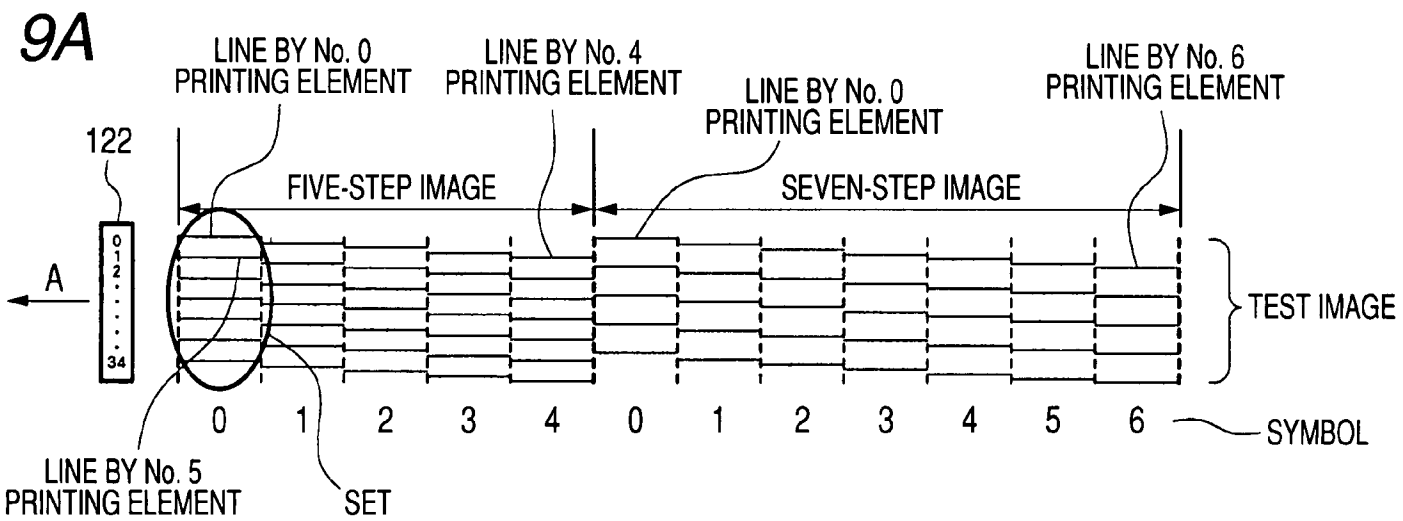
FIGS. 9A and 9B are views showing the other example of the test image.
Figure 9B:
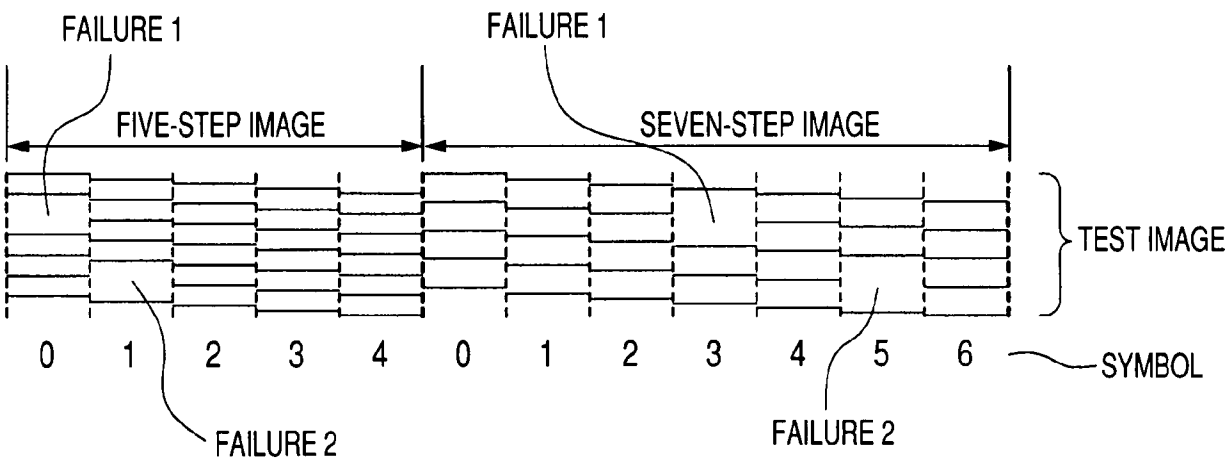

FIGS. 9A and 9B show other examples of a test image which is printed out by the printing apparatus 12 on the basis of the test image data produced by the drawing controlling portion 100. The test images of the examples are drawn by a printing head 122 in which 35 printing elements are arranged.

Referring to FIG. 9A, the test image is drawn by the printing apparatus 12 in the following manner. In the drawing controlling portion 100, the plural (35) printing elements which are arranged in the printing head 122 are divided into plural subarrangements which are configured by the same number of printing elements, and which are continuously arranged. The subarrangements are set to plural kinds so that the numbers of belonging printing elements constitute a combination of numbers (5 and 7) sharing no common devisor other than 1. In each kind of subarrangement, the test image data are produced so that printing elements placed in corresponding positions in the subarrangements sequentially draw lines in the predetermined direction (sheet feed direction) of a recording medium. The direction of the arrow A in FIG. 9A coincides with the sheet feed direction. In the printing head 122, the printing elements are arranged in a direction intersecting (for example, perpendicular to) the sheet feed direction.

Figure 10:
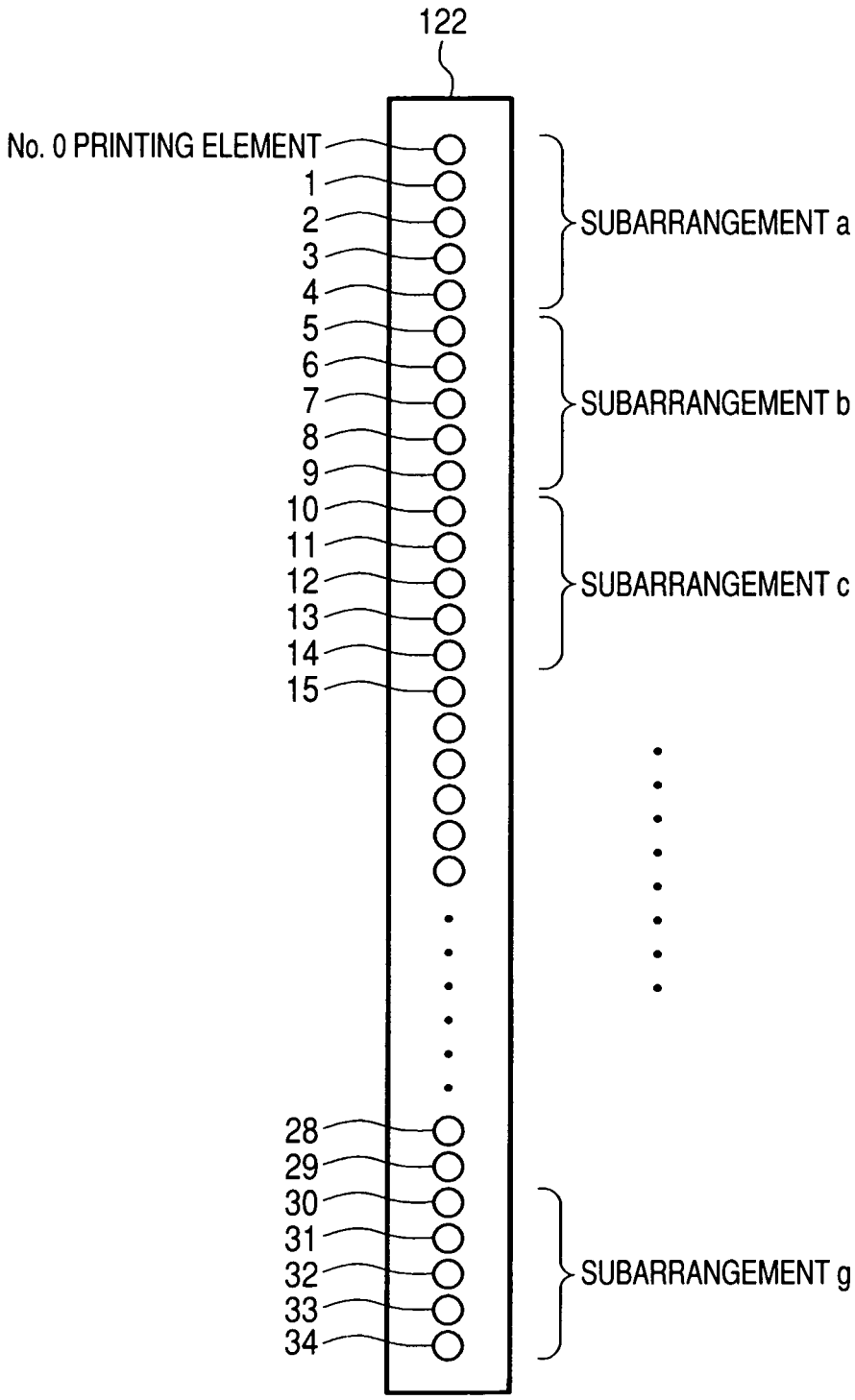
FIG. 10 is a view showing an example of the arrangement of printing elements in a printing head.

FIG. 10 shows an example of the arrangement of the printing elements in the printing head 122. In FIG. 10, 35 printing elements are arranged. When numbers of from 0 to 34 (the total number of 35) are allocated to the printing elements, 7 (a to g) subarrangements each having 5 printing elements are set, and the subarrangements a to g include printing elements of Nos. 0 to 4, Nos. 5 to 9, Nos. 10 to 14, Nos. 15 to 19, Nos. 20 to 24, Nos. 25 to 29, and Nos. 30 to 34, respectively. The printing elements at positions which correspond to one another in the subarrangements, i.e., I: (Nos. 0, 5, 10, 15, 20, 25, and 30), II: (Nos. 1, 6, 11, 16, 21, 26, and 31), III: (Nos. 2, 7, 12, 17, 22, 27, and 32), IV: (Nos. 3, 8, 13, 18, 23, 28, 33), V: (Nos. 4, 9, 14, 19, 24, 29, and 34) are caused to draw lines having the same length in the sheet feed direction in the sequence (I to V) of the parentheses, thereby drawing a five-step image in which 5 line sets each configured by 7 parallel lines that are separated at equal intervals from one another are formed. In FIG. 9A, the printing elements described in the parentheses draw the parallel lines in the sequence of the parentheses. The sequence of the parentheses is not restricted to the above, and may be another sequence. FIG. 10 shows the example in which the printing elements are arranged in one row. However, the arrangement of the printing elements is not restricted to this as far as the intervals of the printing elements in a direction perpendicular to the relative moving direction of the printing head 122 and the recording medium in the printing process are equal to one another. For example, printing elements may be arranged two-dimensionally as in a case such as that printing elements are arranged in a staggered manner.

Similarly, 5 subarrangements each having 7 printing elements are set. Therefore, a seven-step image in which 7 line sets each configured by 5 parallel lines that are separated at equal intervals from one another are formed are drawn.

As described above, in FIG. 9A, the test image is formed by two line groups configured by the above-described five- and seven-step images. In this case, the numbers of the sets included in the line groups are equal to the numbers of printing elements included in the subarrangements, or 5 and 7, and constitute a combination of numbers sharing no common devisor other than 1 (hereinafter, this relationship is referred to as "relatively prime"). Preferably, the test image is configured so as to be drawn by one scan of the printing head 122 under the control of the head driving portion 120. In the test image, also symbols for identifying the printing elements may be drawn. In the example shown in FIG. 9A, the symbols are numbers starting at 0 and added to the sets. In the five-step image, numbers of 0 to 4 are added, and, in the seven-step image, numbers of 0 to 6 are added. The symbols are requested to identify line sets included in one line group, and may be symbols (for example, A, B, C, . . . ) other than numerals.

FIG. 9B shows an example of the test image in the case where the print disabled state (state where drawing is disabled) occurs in a part of the printing elements arranged in the printing head 122. In the example, the print disabled state occurs in two printing elements, and the printing elements are referred to as failure 1 and failure 2, respectively. The printing elements which cannot perform drawing produce portions (vanishing positions) where the lines vanish, in the five- and seven-step images.

In the test image in the exemplary embodiment, as described above, the numbers of the sets included in the line groups are relatively prime, and hence the printing elements in the print disabled state can be identified on the basis of the vanishing position. The printing elements are indicated by serial numbers starting at 0, and the serial number of a printing element in the print disabled state is X. In the five-step image, the vanishing position appears at a position of a symbol corresponding to the remainder of X/5, and, in the seven-step image, the vanishing position appears at a position of a symbol corresponding to the remainder of X/7. The step numbers, i.e., the numbers of the sets included in the line groups are relatively prime, and the combinations of the numbers and X above have a one-to-one relationship. When a table in which a combination of the remainder is associated with the serial number X of a printing element in the print disabled state is previously prepared, therefore, it is possible to easily identify the printing element in the print disabled state.

In the exemplary embodiment, as shown in FIGS. 9A and 9B, the configuration where the five- and seven-step images are used and identification is enabled with respect to the printing head 122 in which the 35 printing elements are arranged is employed. The number of the printing elements of the printing head 122 may be set in a range of the least common multiple (in the examples of FIGS. 9A and 9B, 5×7) of the step number of the selected image. Also, a printing element in the print position abnormal state can be identified by a method similar to that of FIGS. 9A and 9B.

As described above, also in the test image shown in FIG. 9A or 9B, a printing element in a print disabled or print position abnormal state can be identified. Therefore, it can be used in collection of information relating to the operation state of the printing element which is to be input through the input screen shown in FIG. 5 and the like.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A print control apparatus comprising:

an operation state storing section that stores operation information relating to operation states of a plurality of printing elements arranged in a printing head; and a drawing controlling section that causes the plurality of printing elements to draw a test image for checking the operation states of the plurality of printing elements, wherein the test image includes a set of a predetermined number of lines that are drawn in parallel with one another in a predetermined direction, each of the lines being drawn by a different printing element of the plurality of printing elements, the drawing controlling section causes two printing elements, of the plurality of printing elements, that are placed in the vicinity of a separate, malfunctioning printing element, of the plurality of printing elements, that is determined as a malfunction on the basis of the operation information, to each additionally draw in the test image a separate check line having a predetermined length and thickness, each of the two check lines being drawn adjacent to one of the lines of the set of predetermined number of lines, the thickness of the two check lines is set in advance to be greater than the thickness of the lines of the set of predetermined number of lines, and the two check lines are separated from each other by a predetermined distance in a length direction.

2. The print control apparatus as claimed in claim 1, wherein the drawing controlling section changes the length or thickness of the check line drawn in the test image in accordance with the state of the printing element determined as a malfunction.

3. The print control apparatus as claimed in claim 1, wherein the printing element placed in the vicinity of the printing element determined as a malfunction is a printing element adjacent to the printing element determined as a malfunction.

4. The print control apparatus as claimed in claim 3, wherein the printing element placed in the vicinity of the printing element determined as a malfunction includes two printing elements that is respectively situated on both sides of the printing element determined as a malfunction.

5. The print control apparatus as claimed in claim 3, wherein the printing element adjacent to the printing element determined as a malfunction includes two sets each having two printing elements, the two sets being respectively situated on both sides of the printing element determined as a malfunction.

6. The print control apparatus as claimed in claim 1, wherein the drawing controlling section changes the lengths of the check lines to be drawn in the test image on the basis of the operation information.

7. The print control apparatus as claimed in claim 1, wherein the drawing controlling section causes a printing element being different in color from the printing element determined as a malfunction to draw the check line.

8. A print control apparatus comprising:

an operation state accepting section that accepts operation information input by an operator on the basis of a test image for checking operation states of a plurality of printing elements arranged in a printing head, the operation information relating to an operation state of a printing element;

an operation state storing section that stores the operation information; and a drawing controlling section that causes the plurality of printing elements to draw a test image for checking the operation states of the printing elements, wherein the test image includes a set of a predetermined number of lines that are drawn in parallel with one another in a predetermined direction, each of the lines being drawn by a different printing element of the plurality of printing elements, the drawing controlling section causes two printing elements, of the plurality of printing elements, that are placed in the vicinity of a separate, malfunctioning printing element, of the plurality of printing elements, that is determined as a malfunction on the basis of the operation information, to each additionally draw in the test image a separate check line having a predetermined length and thickness, each of the two check lines being drawn adjacent to one of the lines of the set of predetermined number of lines, the thickness of the two check lines is set in advance to be greater than the thickness of the lines of the set of predetermined number of lines, and the two check lines are separated from each other by a predetermined distance in a length direction.

9. The print control apparatus as claimed in claim 8, wherein the operation information accepted by the operation state accepting section includes a serial number and operation state of the printing element.

10. The print control apparatus as claimed in claim 9, wherein the operation information includes information relating to print disabled state and print position abnormal state.

11. A print control apparatus comprising:

an operation state detecting section that detects the operation states of a plurality of printing elements arranged in the printing head;

an operation state storing section that stores the operation information; and a drawing controlling section that causes the plurality of printing elements to draw a test image for checking the operation states of the printing elements, wherein the test image includes a set of a predetermined number of lines that are drawn in parallel with one another in a predetermined direction, each of the lines being drawn by a different printing element of the plurality of printing elements, the drawing controlling section causes two printing elements, of the plurality of printing elements, that are placed in the vicinity of a separate, malfunctioning printing element, of the plurality of printing elements, that is determined as a malfunction on the basis of the operation information, to each additionally draw in the test image a separate check line having a predetermined length and thickness, each of the two check lines being drawn adjacent to one of the lines of the set of predetermined number of lines, the thickness of the two check lines is set in advance to be greater than the thickness of the lines of the set of predetermined number of lines, and the two check lines are separated from each other by a predetermined distance in a length direction.

12. The print control apparatus as claimed in claim 1, wherein the length direction is parallel to the predetermined direction of the set of predetermined number of lines.

13. The print control apparatus as claimed in claim 8, wherein the length direction is parallel to the predetermined direction of the set of predetermined number of lines.

14. The print control apparatus as claimed in claim 11, wherein the length direction is parallel to the predetermined direction of the set of predetermined number of lines.

15. The print control apparatus according to claim 1, wherein the printing head is a single head chip.

16. The print control apparatus according to claim 8, wherein the printing head is a single head chip.

17. The print control apparatus according to claim 11, wherein the printing head is a single head chip.

* * * * *